US006231137B1

(12) United States Patent
Lye et al.

(10) Patent No.: US 6,231,137 B1
(45) Date of Patent: May 15, 2001

(54) COMBINATION COUNTERTOP OVEN AND COOLING RACK ASSEMBLY

(75) Inventors: Michael T. Lye, Warwick; Luke N. Michas, North Providence; Jeremy C. Howard, Little Compton; Edgar L. Laguinia, Portmouth, all of RI (US); Elizabeth Akers, Chicago, IL (US); Seung Park, Newtonville, MA (US); Marc S. Harrison, deceased, late of Portmouth, RI (US), by Diana Harrison, executor; Peter Wooding; Jane K. Langmuir, both of Providence, RI (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 09/440,122

(22) Filed: Nov. 15, 1999

(51) Int. Cl.[7] ..... A47B 96/18
(52) U.S. Cl. ..... 312/140.4; 312/238; 312/236
(58) Field of Search ..... 312/140.1, 140.3, 312/140.4, 410, 139.2, 236, 237, 279, 128, 132, 176, 322, 238; 108/90

(56) References Cited

U.S. PATENT DOCUMENTS 1,719,357 * 7/1929 Binns ..... 312/322 X
2,432,397 * 12/1947 Earle ..... 312/236 X
2,550,539 * 4/1951 Earle .
2,882,114 * 4/1959 Sease et al. ..... 312/279
3,011,849 12/1961 Bishop, Jr. .
3,013,851 12/1961 Maron .
3,186,398 * 6/1965 Poracki ..... 312/236 X
4,397,508 * 8/1983 Bohnet et al. ..... 312/238 X
4,400,045 * 8/1983 Baschin ..... 312/236
4,436,356 3/1984 Stelling .
5,158,068 * 10/1992 Pickering ..... 108/90 X
5,312,178 * 5/1994 King ..... 312/140.4
5,539,184 7/1996 Su .
5,640,946 * 6/1997 Oslin .

* cited by examiner

*Primary Examiner*—Janet M. Wilkens
(74) *Attorney, Agent, or Firm*—Everett G. Diederiks, Jr.

(57) ABSTRACT

A cooling or support rack is embedded into a work surface of a countertop at a position generally, directly in front of one or more doors of an oven arranged above the countertop. Preferably, the oven incorporates a pair of arcuate, sliding doors which are movable from a closed position to an open position wherein the doors do not extend over the cooling rack. The upper surface of the cooling rack is substantially flush with both the countertop and a lowermost cookware support surface within the oven such that cookware can be readily slid into and out of the oven.

20 Claims, 2 Drawing Sheets

COMBINATION COUNTERTOP OVEN AND COOLING RACK ASSEMBLY

BACKGROUND OF THE INVENTION

1. Field of the Invention

The present invention pertains to the art of cooking and, more particularly, to the combination of a countertop oven and a cooling rack.

2. Discussion of the Prior Art

In the art of cooking, there have been various ways in which ovens have been mounted, as well as many different energy sources utilized with such ovens. For example, it is conventional to provide either an electric or gas range between two sections of a kitchen countertop such that an oven of the range is located below the level of the countertop. It is also fairly common to find an oven mounted in a wall within a kitchen. With either of these types of arrangements, the oven will incorporate a door which pivots about a lower, generally horizontal axis, such that, upon opening of the door, the door projects forwardly of a cavity of the oven. This positioning of the door mandates that a user either stand to the side or lean over the door in order to access the oven cavity when either placing food items to be cooked within the oven cavity or removing the items therefrom. This positioning of the door is not always extremely convenient, particularly when removing hot items from the oven cavity which have to be lifted and carried to another support surface.

Microwave ovens are also commonly found in households today. Microwave ovens are typically either supported directly upon a countertop or mounted in a spaced relationship above a range and between wall cabinets. These types of ovens generally have an associated door which is hinged about a substantially vertical axis at one upright edge portion thereof. With such an arrangement, when the door is opened, easy access to food items and containers within a cavity of the oven is available. Therefore, a user can readily remove the food or container from the oven and carry the same to a remote serving position. In addition, particularly with respect to microwave ovens but also applicable to more conventional ovens, it is sometimes required to remove a food container from an oven cavity before cooking is completed in order to stir the contents of the container for further cooking. During such times, the food container is generally placed on a countertop or another cooking surface which will provide the required stability for the container.

Because containers are typically quite hot when removed from ovens, it is not too uncommon to find a certain percentage of the cookware slips and breaks while being transferred to and from the oven. In order to address this concern, at least with respect to microwave ovens, it has been proposed to interpose a base between a microwave oven and a countertop, wherein the base incorporates a slidable cookware support which will aid in transferring cookware to and from the cavity of the oven. Such an arrangement is represented in U.S. Pat. No. 4,436,356. Although the presence of such a supplemental cookware support can be advantageous in various situations, the arrangement is considered to have various drawbacks. For instance, the support is particularly adapted for use in removing a food container from the oven cavity prior to final completion of the cooking cycle such that the food therein can be stirred and then placed back in the oven cavity. Due to the arrangement of the support and the manner in which the door for the microwave oven is opened and closed, once a piece of cookware is placed on the support, the door cannot be shifted between the opened and closed positions. Therefore, the support is not particularly useful following completion of the cooking operation, unless it is desired to maintain the door of the microwave oven open. Furthermore, since the cookware support must project forward of a frontal edge of the countertop during use, a hazard may be presented wherein an individual can bump into the support and possibly even knock the entire microwave oven off the countertop.

Regardless of the proposals made in the art, there exists a need in the art for a combination oven and cooling rack assembly which provides for a convenient arrangement for shifting cookware and/or food items into and out of a cavity of the oven. More specifically, there exists a need for an oven construction which provides for food items to be easily placed in or removed from a cavity of the oven while being unobstructed from a door associated with the cavity. In addition, there exists a need for a support to be used with such an oven wherein food containers can be readily removed from the oven cavity and positioned on the support with a greatly reduced concern of possible damage being caused to the cookware or other accidents.

SUMMARY OF THE INVENTION

The present invention pertains to a combination countertop oven and cooking rack assembly including an oven unit having an open frontal portion including a lower edge which is at or below a level of a countertop work surface. The frontal opening leads to an oven cavity which can be selectively closed by movement of one or more doors. In the most preferred form of the invention, a pair of arcuate, slidably mounted doors are utilized which, when opened, provide clear access to within the oven cavity. The frontal opening is also spaced rearward of a front edge of the countertop such that a portion of the countertop projects forward of the oven cavity. The countertop supports a cooling rack at a position directly in front of the opening of the oven cavity.

With this arrangement, the cooling rack is conveniently located for supporting cookware to be placed into or removed from the oven cavity. Actually, a lowermost rack or support within the oven cavity is preferably at the same level as the cooling rack such that the container can be simply slid into or out of the oven cavity. Furthermore, the cooling rack is preferably embedded into the countertop such that an upper surface of the cooling rack is flush with an upper work surface of the countertop. In the most preferred form of the invention, the cooling rack constitutes a metal plate, such as a stainless steel plate, provided with a plurality of spaced apertures for enhancing heat dissipation.

Additional objects, features and advantages of the present invention will become more readily apparent from the following detailed description of a preferred embodiment thereof when taken in conjunction with the drawings wherein like reference numerals prefer to corresponding parts on the several views.

DETAILED DESCRIPTION OF A PREFERRED EMBODIMENT

Figure 1:
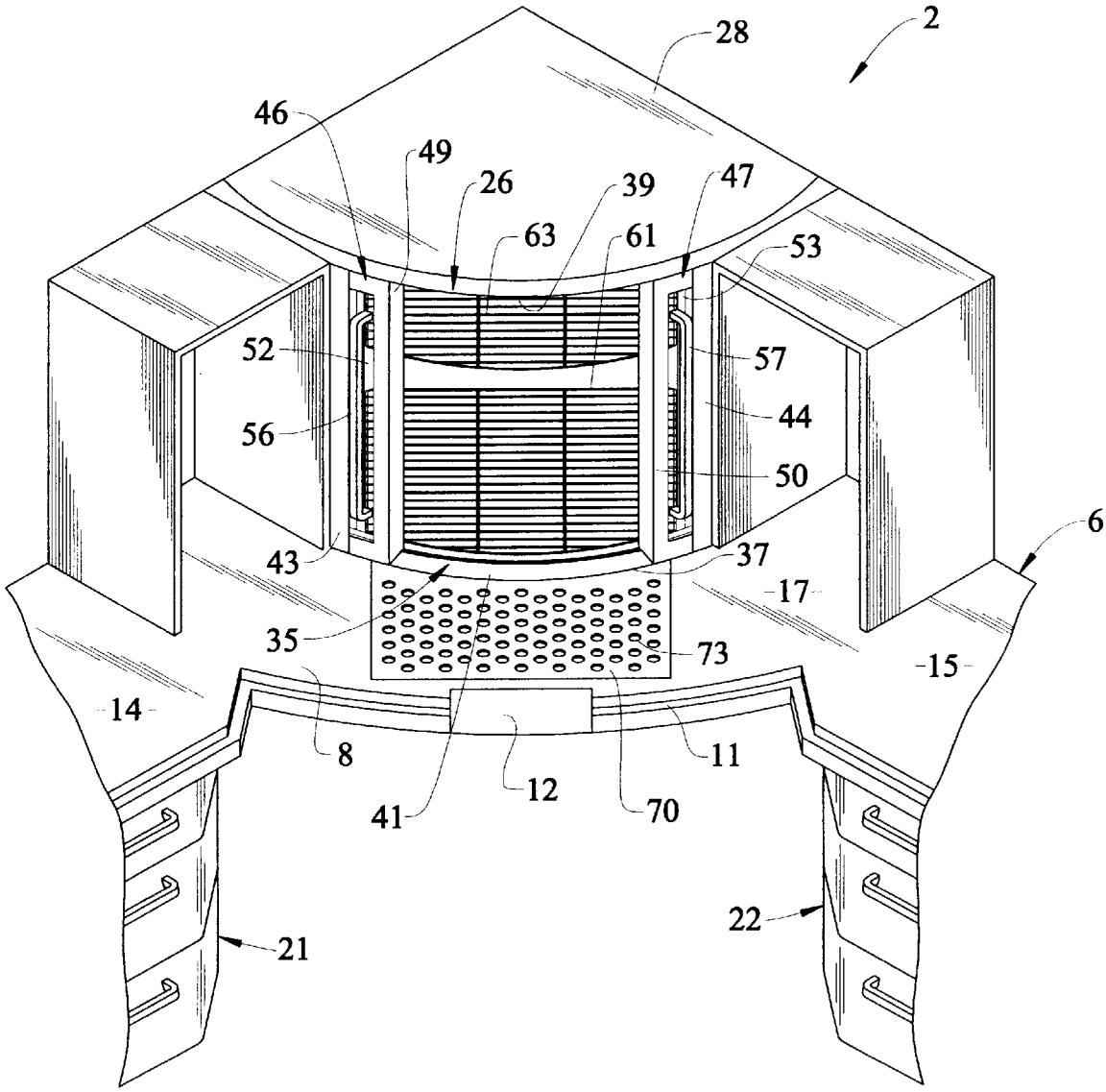
FIG. 1 is an upper front perspective view of a countertop oven a cooling rack assembly constructed in accordance with the present invention.

With initial reference to FIG. 1, the countertop oven and cooling rack assembly of the present invention is generally indicated at 2. Assembly 2 incorporates a countertop 6 having a substantially planar upper work surface 8. Upper work surface 8 is shown to include a frontal edge 11 with a central sloping section 12, the presence of which will be detailed more fully below. In the embodiment shown, countertop 6 is partially shown to include a left wing 14, a right wing 15 and a central section 17. Left and right wings 14 and 15 are partially shown to include respective sets of lower cabinet drawers 21 and 22 for the sake of completeness. Positioned above countertop 6 is an oven unit 26 clearly shown in each of FIGS. 1 and 2. In the embodiments shown, oven unit 26 is mounted in a corner of countertop 6 and includes an outer housing 28 and an insulated inner housing 30 that defines an oven cavity 32. Oven cavity 32 includes a frontal opening 35 having a lower edge 37 and an upper edge 39. In the most preferred form of the invention, lower and upper edges 37 and 39 generally define guide tracks such as indicated at 41 for lower edge 37. As perhaps best illustrated in FIG. 2, each guide track 41 extends between portions of outer housing 28, with outer sections of guide tracks 41 being visually blocked in FIG. 1 by means of side trim pieces 43 and 44.

Figure 2:
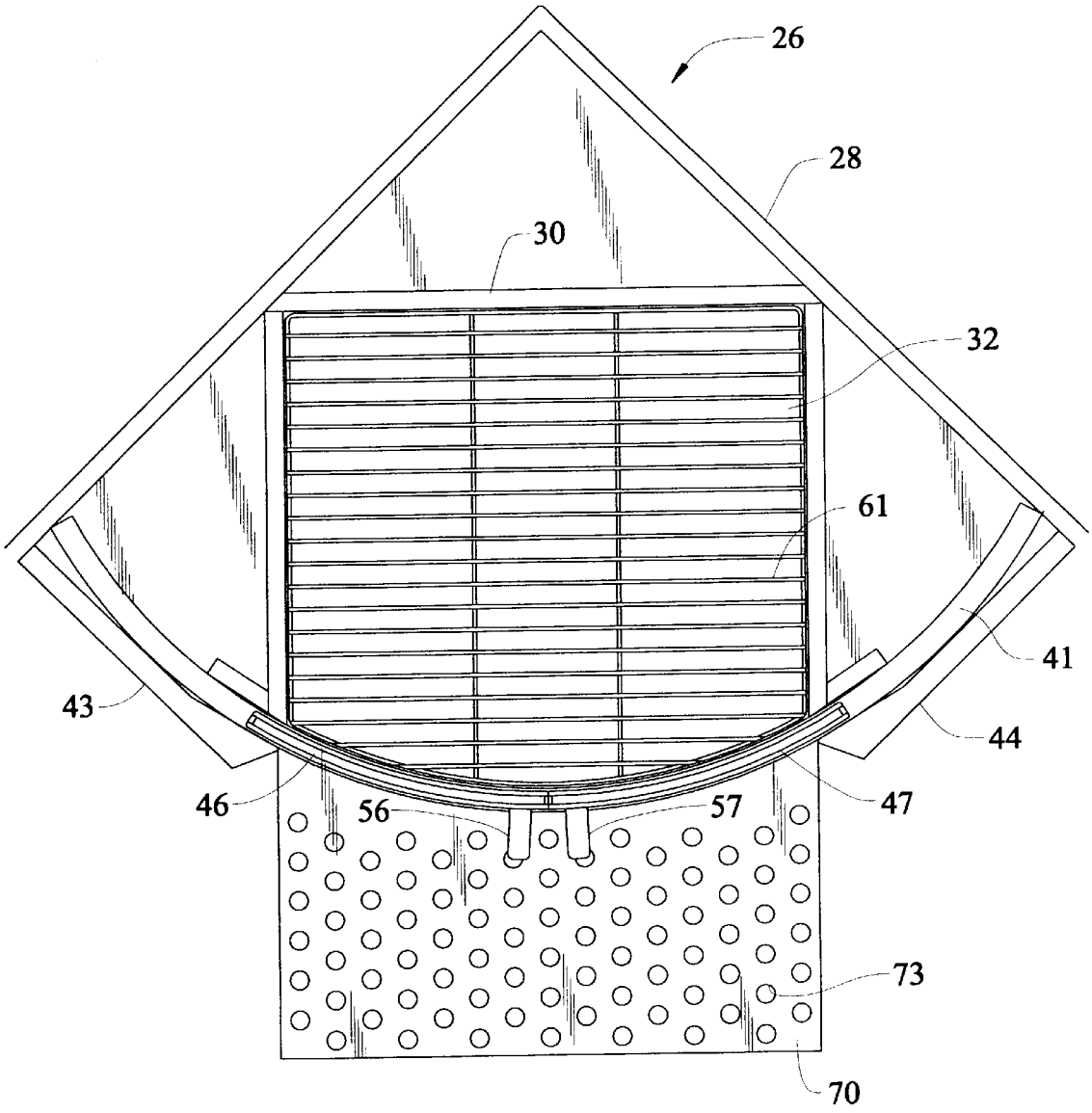
FIG. 2 is generally a top view of the oven and cooling rack arrangement of FIG. 1, with a top section of the oven unit being removed in order to detail internal structure.

Lower guide track 41 is incorporated in the preferred embodiment of oven unit 26 to guidably support, in combination with the upper guide track (not labeled) formed at upper edge 39, a pair of slidable doors 46 and 47. In the preferred form shown, doors 46 and 47 each include a respective outer peripheral frame 49, 50 and a central, tempered glass panel 52, 53. In addition, each door 46, 47 is provided with a respective handle 56, 57. With this configuration, frontal opening 35 can be selectively accessed by positioning doors 46 and 47 in their respective retracted positions as shown in FIG. 1 or frontal opening 35 can be closed by bringing doors 46 and 47 together as shown in FIG. 2. At this point, it should be realized that both doors 46 and 47 are incorporated in the preferred embodiment to provide a more compact overall oven unit 26. In addition, the use of sliding doors assures that the doors 46 and 47 will not encumber direct access to oven cavity 32 through frontal opening 35. However, it should be recognized that a single sliding or panagraphic door could be utilized, as well as one or more pivoting doors without departing from the spirit of the invention.

Oven unit 26 can have various, vertically spaced internal cooking surfaces. As shown, oven cavity 32 includes a lower cooking rack 61 and an upper cooking rack 63. In the most preferred form of the invention, the lower cooking surface within oven cavity 32, i.e., lower cooking rack 61 in the embodiment shown, is substantially in a common horizontal plane with work surface 8 of countertop 6, while guide track 41 is slightly recessed relative to this planar surface.

In accordance with the invention, integrated with cooktop 6, preferably directly in front of frontal opening 35 is a cooling or support rack 70. In the most preferred form of the invention, cooling rack 70 is embedded within countertop 6 such that an upper surface thereof is flush with work surface 8. Therefore, cooling rack 70 is also in a common plane with the lowermost support, i.e., rack 61, for cookware to be positioned within oven cavity 32. The structure of cooling rack 70 can take various forms in accordance with the invention. However, the most preferred form utilizes a metal, preferably stainless steel, plate that is provided with a plurality of spaced apertures 73. A ceramic rack or insert could also be readily utilized.

With this overall arrangement, cookware or other food items to be placed within oven cavity 32 or removed therefrom can be readily positioned upon cooling rack 70. Given that cooling rack 70 is flush with both work surface 8 of countertop 6 and cooking rack 61 within oven cavity 32, cookware can be readily slid into oven cavity 32 or shifted off of cooling rack 70 directly upon work surface 8. The ability of cookware to be readily slid into and out of oven cavity 32 in this manner is also enhanced by the remote positioning of doors 46 and 47 when in their retracted positions as shown in FIG. 1 and detailed above. In any event, the overall countertop oven and cooling rack assembly 2 of the present invention provides for the safe and convenient repositioning of food items into and out of oven cavity 32. It should be recognized that oven unit 26 can take various forms in accordance with the present invention, including electric, gas, microwave, hot air impingement and the like type ovens. Although not shown for the sake of simplicity, it is preferable that controls for oven unit 26 be provided at sloping section 12, with the controls extending below the plane of work surface 8 and cooling rack 70. In any event, although described with respect to a preferred embodiment of the invention, it should be readily understood that various changes and/or modifications can be made to the invention without departing from the spirit thereof. Instead, the invention is only intended to be limited by the scope of the following claims.

We claim:

1. A combination countertop oven and cooling rack assembly comprising:

a countertop including a substantially planar work surface having a front edge;

an oven including a frontal opening and at least one door for selectively closing the frontal opening, said frontal opening being exposed above the work surface and spaced rearward of the front edge; and a cooling rack integrated into and fixed within the countertop in front of the frontal opening of the oven.

2. The assembly according to claim 1, wherein the cooling rack is embedded into the countertop at a position between the oven and the front edge of the countertop.

3. The assembly according to claim 2, wherein the cooling rack has an upper surface which is substantially flush with the work surface of the countertop.

4. The assembly according to claim 3, wherein the cooling rack is formed of metal.

5. The assembly according to claim 4, wherein the upper surface of the cooling rack is formed with a plurality of spaced apertures.

6. The assembly according to claim 1, wherein the oven includes first and second doors for selectively closing the frontal opening, with the first and second doors meeting in a central section of the frontal opening.

7. The assembly according to claim 6, wherein first and second doors are slidably mounted between open and closed positions.

8. The assembly according to claim 7, wherein the oven incorporates an outer housing and an inner housing, said inner housing defining an oven cavity, with said doors extending into the outer housing when in the open position.

9. The assembly according to claim 7, wherein each of the first and second doors slide along an arcuate path between the open and closed positions.

10. The assembly according to claim 1, wherein the oven is provided within an internal, lower cookware support which is located in a plane substantially commensurate with an upper surface of the cooling rack.

11. A combination contertop oven and cooling rack assembly comprising:

a countertop including a substantially planar work surface having a front edge;

an oven including a frontal opening having a lower edge which is at or below a level of the work surface and an upper edge which is located above the level of the work surface, and at least one door for selectively closing the frontal opening, said work surface projecting in front of the frontal opening; and a cooling rack supported by the countertop in front of the frontal opening.

12. The assembly according to claim 11, wherein the cooling rack is embedded into and fixed within the countertop at a position between the oven and the front edge of the countertop.

13. The assembly according to claim 12, wherein the cooling rack has an upper surface which is substantially flush with the work surface of the countertop.

14. The assembly according to claim 13, wherein the cooling rack is formed of metal.

15. The assembly according to claim 14, wherein the upper surface of the cooling rack is formed with a plurality of spaced apertures.

16. The assembly according to claim 11, wherein the oven includes first and second doors for selectively closing the frontal opening, with the first and second doors meeting in a central section of the frontal opening.

17. The assembly according to claim 16, wherein first and second doors are slidably mounted between open and closed positions.

18. The assembly according to claim 17, wherein each of the first and second doors slide along an arcuate path between the open and closed positions.

19. The assembly according to claim 17, wherein the oven incorporates an outer housing and an inner housing, said inner housing defining an oven cavity, with said doors extending into the outer housing when in the open position.

20. The assembly according to claim 11, wherein the oven is provided within an internal, lower cookware support which is located in a plane substantially commensurate with an upper surface of the cooling rack.

* * * * *